US011814841B2

(12) United States Patent
Warner et al.

(10) Patent No.: US 11,814,841 B2
(45) Date of Patent: Nov. 14, 2023

(54) FOAM FILLED STRUCTURAL PLANK BUILDING FOUNDATION WITH LAMINATED REINFORCEMENT

(71) Applicant: PLANK STRUCTURAL SYSTEMS LLC, Mill Valley, CA (US)

(72) Inventors: David Warner, Mill Valley, CA (US); James Babcock, Mill Valley, CA (US)

(73) Assignee: PLANK STRUCTURAL SYSTEMS LLC, Mill Valley, CA (US)

( * ) Notice: Subject to any disclaimer, the term of this patent is extended or adjusted under 35 U.S.C. 154(b) by 88 days.

(21) Appl. No.: 17/885,292

(22) Filed: Aug. 10, 2022

(65) Prior Publication Data

US 2023/0049445 A1 Feb. 16, 2023

Related U.S. Application Data

(60) Provisional application No. 63/289,816, filed on Dec. 15, 2021, provisional application No. 63/232,425, filed on Aug. 12, 2021.

(51) Int. Cl.
*E04C 2/24* (1970.01)

(52) U.S. Cl.
CPC ..... *E04C 2/243* (2013.01); *E04C 2/16* (2013.01); *E04C 2/205* (2013.01)

(58) Field of Classification Search
CPC ..... E04C 2/243; E04C 2/16; E04C 2/205
See application file for complete search history.

(56) References Cited

U.S. PATENT DOCUMENTS 2,858,580 A 11/1958 Thompson et al.
3,000,144 A 9/1961 Kitson
3,783,082 A * 1/1974 Almog ..... E04C 2/34 428/56
3,785,913 A 1/1974 Hallamore
4,109,436 A 8/1978 Berloty
4,177,618 A 12/1979 Felter
4,625,484 A 12/1986 Oboler
5,584,151 A 12/1996 Abou-Rached
5,666,780 A 9/1997 Romes et al.
5,701,708 A 12/1997 Taraba et al.
5,785,904 A 7/1998 Abou-Rached
5,862,639 A 1/1999 Abou-Rached
6,226,943 B1 5/2001 Grinshpun et al.
7,021,014 B1 4/2006 Wolfe
7,100,336 B2 9/2006 Messenger et al.
7,127,856 B2 10/2006 Hagen, Jr. et al.
7,168,216 B2 1/2007 Hagen, Jr.
(Continued)

FOREIGN PATENT DOCUMENTS

CN 106703267 A 5/2017
KR 20170120384 A * 10/2017
(Continued)

OTHER PUBLICATIONS

Development of an Innovative Modular Foam-Filled Panelized System for Rapidly Assembled Postdisaster Housing, P. Sharafi et al., Buildings, Jul. 30, 2018, 15 pages.
https://globepanels.com/application-insulated-metal-panels/, Application of Insulated Metal Panels, Globe Panels, 2014-2022, 7 pages.
(Continued)

*Primary Examiner* — Babajide A Demuren
(74) *Attorney, Agent, or Firm* — David R. Heckadon; Gordon Rees Scully Mansukhani LLP

(57) ABSTRACT

A foam filled structural plank made from a plurality of structural beams assembled together to form a structure capable of supporting the weight of a building thereon, wherein the plurality of structural beams define an enclosure therebetween and an outer perimeter therearound; and a structural building foam such as having expanded polystyrene foam having a density from 1.5 to 3.0 PFC filling the enclosure.

21 Claims, 13 Drawing Sheets

(56) References Cited

U.S. PATENT DOCUMENTS

| | | | | |
|---|---|---|---|---|
| 7,574,837 | B2 | 8/2009 | Hagen, Jr. et al. | |
| 7,788,879 | B2 | 9/2010 | Brandes et al. | |
| 7,905,067 | B2 | 3/2011 | Schiffmann et al. | |
| 7,926,233 | B2 | 4/2011 | Schiffmann et al. | |
| 7,926,241 | B2 | 4/2011 | Schiffmann et al. | |
| 7,930,861 | B2 | 4/2011 | Schiffmann et al. | |
| 8,012,301 | B2 | 9/2011 | Schiffmann et al. | |
| 8,033,065 | B2 | 10/2011 | Paetkau et al. | |
| 8,082,711 | B2 | 12/2011 | Schiffmann et al. | |
| 8,266,867 | B2 | 9/2012 | Schiffmann et al. | |
| 8,272,190 | B2 | 9/2012 | Schiffmann et al. | |
| 8,322,097 | B2 | 12/2012 | Schiffmann et al. | |
| 8,322,098 | B2 | 12/2012 | Schiffmann et al. | |
| 8,393,123 | B2 | 3/2013 | Schiffmann et al. | |
| 8,516,777 | B2 | 8/2013 | Schiffmann et al. | |
| 8,534,028 | B2 | 9/2013 | Wojtusik et al. | |
| 8,607,531 | B2 | 12/2013 | Schiffmann et al. | |
| 8,793,966 | B2 | 8/2014 | Schiffmann et al. | |
| 8,904,737 | B2 | 12/2014 | Schiffmann et al. | |
| 9,222,261 | B2 | 12/2015 | Weeks | |
| 9,447,557 | B2 | 9/2016 | Schiffmann et al. | |
| 9,493,938 | B2 | 11/2016 | Schiffmann et al. | |
| 9,556,612 | B2 | 1/2017 | Bottin | |
| 9,562,359 | B1 | 2/2017 | Grisolia et al. | |
| 10,385,566 | B2 | 8/2019 | Carlson | |
| 10,801,197 | B2* | 10/2020 | Fox et al. | E04B 1/10 |
| 11,214,958 | B1* | 1/2022 | Lambach | E04B 1/762 |
| 2002/0069600 | A1 | 6/2002 | Bryant | |
| 2004/0050001 | A1 | 3/2004 | Williams | |
| 2004/0148889 | A1* | 8/2004 | Bibee et al. | E04B 1/78 52/745.09 |
| 2005/0055973 | A1* | 3/2005 | Hagen, Jr. et al. | B29C 44/18 52/741.1 |
| 2005/0055982 | A1* | 3/2005 | Medina | E04B 1/80 52/506.01 |
| 2006/0117689 | A1* | 6/2006 | Onken et al. | E04C 2/22 52/309.7 |
| 2006/0265985 | A1 | 11/2006 | Nichols | |
| 2008/0127604 | A1 | 6/2008 | Schiffmann et al. | |
| 2008/0263968 | A1 | 10/2008 | Day | |
| 2009/0107065 | A1* | 4/2009 | LeBlang | E04B 1/80 52/309.4 |
| 2012/0096785 | A1 | 4/2012 | Weeks | |
| 2013/0031858 | A1 | 2/2013 | Schiffmann et al. | |
| 2014/0150362 | A1 | 6/2014 | Propst | |
| 2014/0174011 | A1* | 6/2014 | Smith | B29C 39/10 52/309.7 |
| 2014/0308385 | A1 | 10/2014 | Schiffmann et al. | |
| 2016/0237683 | A1 | 8/2016 | Husin-Ali | |
| 2016/0356042 | A9 | 12/2016 | Schiffmann et al. | |
| 2019/0242127 | A1* | 8/2019 | Kreizinger | E04B 2/707 |
| 2019/0257081 | A1 | 8/2019 | Heatly | |
| 2019/0352903 | A1* | 11/2019 | Giles et al. | B32B 15/046 |
| 2020/0002946 | A1 | 1/2020 | Nousiainen | |
| 2020/0347593 | A1* | 11/2020 | Ben-Zeev | E04C 2/38 |
| 2020/0354945 | A1* | 11/2020 | Morrow | E04B 5/023 |
| 2021/0087773 | A1 | 3/2021 | Lim | |
| 2022/0002997 | A1 | 1/2022 | Schiffmann et al. | |

FOREIGN PATENT DOCUMENTS

| | | | | |
|---|---|---|---|---|
| NL | 2014205 | B1 | 2/2016 | |
| WO | 2011144941 | A2 | 11/2011 | |
| WO | 2020120384 | A1* | 6/2020 | E04B 1/14 |

OTHER PUBLICATIONS https://wiskindprefab.en.made-in-china.com/product-group/dbhQfmsGbYVw/EPS-sandwich-panel-1.html, EPS Sandwich Panels, Shandong Wiskind Architectural Steel Co., Ltd., 1998-2022, 255 pages.

https://www.cdi-icm.co.uk/system/fastslab-foundation/20140724_152943/, FastSlab Foundation System, CDI Innovative Construction Materials Ltd., Sep. 14, 2016, 7 pages.

https://www.dyplastproducts.com/dyplast-eps/applications/geofoam-1-2-geotechnical-expanded-polystyrene, Geofoam: 1-2 lb/ft3 Geotechnical EPS, Kingspan Insulation, LLC, 2021, 5 pages.

https://www.paragon-protection.com/the-difference-between-spray-foam-densities/, The Difference Between Spray Foam Densities, Paragon Protection, Apr. 14, 2020, 10 pages.

United States International Searching Authority, International Search Report and Written Opinion for corresponding International Application No. PCT/US2022/039962, mailed Nov. 30, 2022, 10 pages.

https://www.pinterest.com/pin/487585097130011116/, Structural Insulated Panel, ECVV, date unknown, 1 page.

* cited by examiner

4' x 4' Heavy Gauge Floor Plank Frame Framing

8' x 20' Heavy Gauge Floor Plank Framing

4' x 4' Heavy Gauge Floor Plank Flexure Test Side View

8' x 20' Light Gauge Floor Plank Framing

FOAM FILLED STRUCTURAL PLANK BUILDING FOUNDATION WITH LAMINATED REINFORCEMENT

RELATED APPLICATION

The present application claims priority to U.S. Provisional Pat. Application Serial No. 63/232,425, filed Aug. 12, 2021, entitled Foam Filled Structural Plank Building Foundation and to U.S. Provisional Pat. Application Serial No. 63/289,816, filed Dec. 15, 2021, of same title, the entire disclosures of which are incorporated herein in their entireties for all purposes.

TECHNICAL FIELD

The present system relates to structural planks, including structural planks for building foundations.

BACKGROUND OF THE INVENTION

A building foundation is used to spread the loads of a building over an area of soil. A proper building foundation distributes these building loads evenly to provide stability to the building. As such, a proper building foundation ensures that differences in the soil underneath the building do not result in subsidence or structural damage to the building.

Traditionally, many building foundations were made with concrete slabs or mountings. A disadvantage of using concrete in building foundations is its high amount of embodied carbon. It would instead be preferable to provide a concrete-free building foundation.

The assembly of a traditional building foundation can be a time-consuming task that requires many different materials and supplies to be delivered to the building site. What is instead desired is a building foundation that requires less materials being delivered to the construction site. Ideally, such a building foundation would be lightweight and could be pre-assembled in a factory setting and then delivered to the building site. Systems for reinforcing such a lightweight building foundation are also desired.

It would also be desirable to use the same systems and techniques that provide building foundations to also provide building walls, ceilings and roof members. Systems for reinforcing and strengthening such lightweight building walls, ceilings and roof members are also desired.

The popularity of building modular homes has been increasing recently. Modular home components are pre-manufactured and then assembled at the job site. This results in a much simpler and faster construction. It would be ideal to provide building structural planks including foundations that could also be quickly and easily installed. Such a system would be simple to build and reduce construction costs.

As will be shown herein, the present building foundation system addresses the above disadvantages.

SUMMARY OF THE INVENTION

In preferred aspects, the present system provides a foam filled structural plank building foundation, comprising: a plurality of structural beams connected together to define a structural plank that can be used as a building foundation being capable of supporting the weight of a building thereon, wherein the plurality of structural beams define an enclosure therebetween and an outer perimeter therearound; and a structural building foam filling the enclosure. Preferably, the structural building foam is an expanded polystyrene foam having a density from 1.5 to 3.0 PFC (pound-force per cubic foot).

In various embodiments, the present structural plank is used as a building foundation. However, as will be shown, using the present techniques of formation and assembly, the present structural plank system can also be used as or in a building wall, ceiling, or roof.

In preferred aspects, the structural building foam has a plurality of openings cut to pass therethrough to permit electrical wiring to pass therethrough, or to be used as HVAC conduits for air to pass through.

In preferred aspects, the structural plank building foundation is mounted onto an array of building piers with inner support walls positioned against the building piers. Such mounting may either be done with the structural plank building foundation resting on the ground, or above ground resting on the array of piers.

The present system also provides a method of forming a foam filled structural plank building foundation, comprising: assembling a plurality of structural beams together to form a structural plank building foundation, wherein the plurality of structural beams define an enclosure therebetween and an outer perimeter therearound; and then filling the enclosure with a structural building foam; and then permitting the structural building foam to set.

In its various aspects, the present building foundation provides a factory-deployable system to support building structures thereon. Advantageously, the buildings supported on the present building foundation can be pre-fabricated, modular, site-built or manufactured buildings.

A first advantage of the present building foundation is that it does not require any concrete. Concrete is an environmentally damaging material in terms of the embodied carbon required in its formation. Therefore, avoiding concrete results in a much more environmentally desirable system. In addition, concrete placement is dependent upon the environmental conditions of the day and its time to reach full strength is not fully predictable. For example, although it may only take a week for concrete to reach 80-90% of its full strength, it is possible that it may take as long as a month to reach full strength. In contrast, the strength of the present system is completely predictable as it is built in a factory and can be delivered to the jobsite rain or shine. In addition, whereas concrete takes a long time to reach its full strength, the present system operates at full strength right at the outset. There is no need to wait for the present system to strengthen at the job site. In addition, there is no need to wait for good weather conditions to install the present system. The present system thus speeds up construction time.

Another advantage of the present building foundation system is that it can be pre-assembled offsite and then delivered to the jobsite. For example, the present building foundation can be manufactured in a factory (offering the benefits of a temperature and moisture-controlled environment when the structural foam is poured into the structural enclosure, and then later cut for air ducting and utility passageways).

Other advantages of the present building foundation are that it can be assembled quickly and is very lightweight. Preferably, the present building foundation is made of steel or aluminum (to form the structural "cage" or enclosure) and foam (that is poured in to fill the cage). After the foam solidifies, the plank structure can then be moved to the jobsite. Steel, aluminum and the foam used are all recyclable. In contrast, traditional concrete is not recyclable.

The structural foam used in the present building foundation offers other advantages. First, the foam is an insulator (giving the entire building foundation assembly a good R-value). In addition, ducting and ducting manifolds, chaseways, and utility knockouts can all be cut into the structural foam when the building foundation is first being assembled in the factory. Preferably, the present foam is an environmentally benign material that does not leach into the atmosphere. As a result, the air ducting HVAC passageways cut in the foam do not require air pipes therein. Rather, air can simply be passed through the ducting passageways directly and thus throughout the building.

Another advantage of the present building foundation is that it can accept dead loads, lateral loads, wind loads and can accommodate loading due to sub-grade pressures and voids required to support a building.

Another advantage of the present building foundation is that its structural members can be connected to the structural members of an adjacent building foundation. As such, for larger buildings, a plurality of the present building foundations can be delivered to a jobsite and then connected together to form a larger building foundation.

Another advantage of the present building foundation is that its structural members can be provided with wall connections such that vertical building walls can be mounted directly to the present structural building foundation.

In further embodiments, at least one laminate panel is either attached to the structural plank building foundation, extends at least partially through the structural plank, or both.

In preferred aspects, these laminate panels may comprise a fabric mesh. In other preferred aspects, these laminate panels may comprise a fossil fuel mesh including, but not limited to, rayon, polypropylene or nylon, most preferably having a weight from 1.5 to 16 oz / square yard. In other preferred aspects, these laminate panels may comprise a carbon-based mesh including, but not limited to, graphene or Kevlar (as made by DuPont), most preferably having a density from 170 g/m$^3$ to 300 g/m$^3$ (or optionally 210-250 g/m$^3$, or 180-290 g/m$^3$). In other preferred aspects, these laminate panels may comprise a plant-based mesh, including, but not limited to, hemp or burlap. In other preferred aspects, these laminate panels may comprise a synthetic acrylic or cementious composite, including, but not limited to, Elephant Armor® (an engineered ductle mortar made by GST Industries of Sparks, NV), Thorocoat® (a coating made by Standard Drywall Products of Miami, FL), EIFS systems Kryton® (a concrete admixture made by Kryton Systems of Vancouver, BC), or HMI mortar (made by Hargett Materials of Milan, TN). In other preferred aspects, these laminate panels may comprise a product made by a pultrusion process that can optionally be fiberglass, graphene, carbon, glass fiber reinforced carbon, or fiberglass based. In other preferred aspects, these laminate panels may comprise wood-based panel products including, but not limited to, cellulosic panels; Plywood, MDF (Medium Density Fiberboard), MDO (Medium Density Overlay), OSB (Oriented Strand Board), Finply® (a plywood panel made by PERI USA of Elkridge, MD), Plyboo® (a bamboo board made by Plyboo of Novato, CA), Hempboard, Flaxboard, Particleboard, or Strawboard. Moreover, the laminate panels may also comprise varying combinations of any of the above listed materials and other suitable materials.

In various approaches, the laminate panel covers a top or bottom (or both) of the structural plank. Alternatively or additionally, laminate panels may instead extend across an inner portion of the structural plank. The various laminate panels operate to provide exceptional strength to the structural plan when the laminate panels are adhered to or positioned within the structural plank. The laminate panels may optionally be adhered to the structural plank by thermal-set epoxy or glue.

In further optional embodiments, a plurality of post-tensioning cables pass through the structural plank to further increase the strength of the structural plank.

In various optional embodiments, the structural beams that are assembled to form the structural plank can themselves be replaced with laminate panels. In these embodiments, no steel or aluminum is required for structural members. Rather, the entire building structural plank can be formed from laminated panels and building foam. It is also to be understood that embodiments where only some of the steel or aluminum structural beams are replaced by laminate panels are also contemplated, all keeping within the scope of the present system.

In those embodiments where the structural plank is not used as a building foundation, the present system broadly comprises a plurality of structural beams connected together to define a structural plank, the structural beams defining an enclosure therebetween and an outer perimeter therearound; a structural building foam poured in to fill the enclosure; and at least one laminate panel attached to the structural plank or extending at least partially through the structural plank.

DETAILED DESCRIPTION OF THE DRAWINGS

Figure 1:
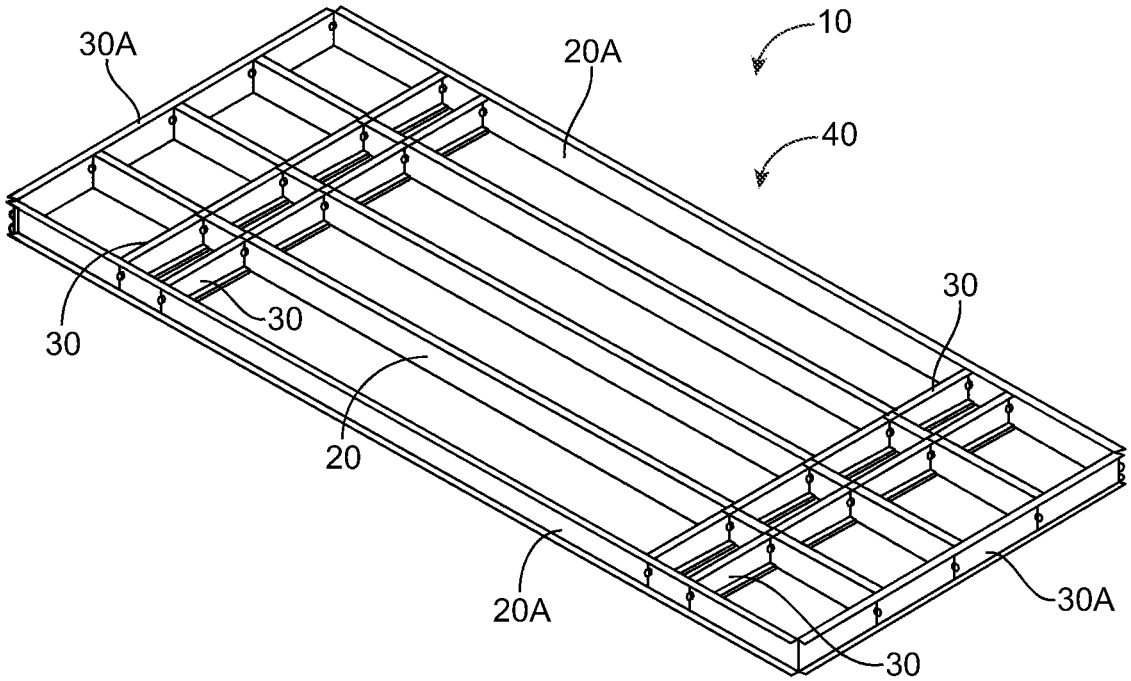
FIG. 1 is a perspective view of one example of the present structural plank building foundation ready for use.
Figure 2:
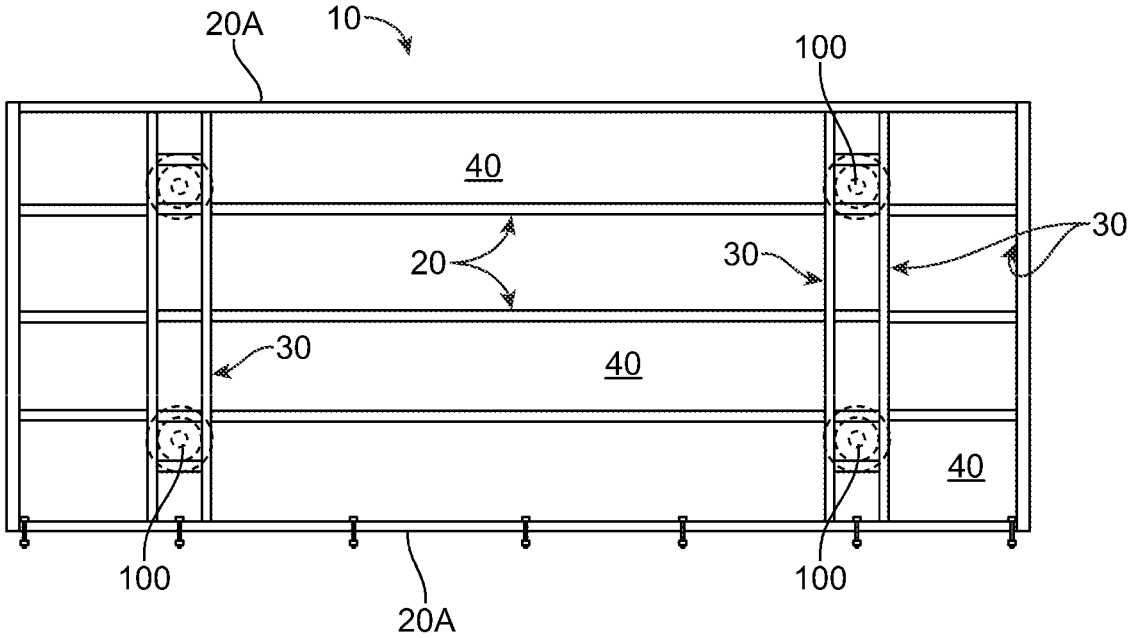
FIG. 2 is a top plan view corresponding to FIG. 1.

FIGS. 1 and 2 illustrate one rectangular example of the present structural plank building foundation 10. It is to be understood that the present system can be assembled into a virtually unlimited of sizes, shapes and dimensions and that the present structural plank building foundation is not limited in any way to the exemplary embodiments illustrated herein. However, the embodiment illustrated in FIGS. 1 and 2 has been built and tested by the Applicant. The testing showed significant strength properties with the structure performing exceptionally well for use in a building foundation. Accordingly, this tested embodiment thus represents a preferred embodiment of the present system.

In its broadest applications, the present system provides a structural plank (including a building foundation) that is filled with a structural foam. In preferred embodiments, the structural foam fully (or nearly completely) fills the present structure contacting all of the structural members that make up the frame for the structural plank. Most preferably, the foam is poured into the structure when the structure is initially assembled in a factory setting (as opposed to being added as blocks of foam material inserted into a frame-type structure at the building jobsite). As will be explained, the Applicant has found that assembling the present structural plank by completely (or nearly completely) filling the structure with foam and then allowing the foam to set provides a strong building foundation. As illustrated, the present system may comprise a plurality of structural beams 20 and 30 that are connected together as shown to define a structural plank building foundation 10. Structural plank building foundation 10 is capable of supporting the weight of a building thereon, and the dimensions and materials used for beams 20 and 30 are designed and selected accordingly. In preferred aspects, beams 20 and 30 are made of steel or aluminum. However, other materials can also be used. The use of structural foam 50 also gives the present assembly a high R value (i.e.: high insulation value). This is fundamentally different from concrete which does not act as an insulator. As such, using concrete would also require adding insulation above or below the concrete. The present system's use of structural foam 50 overcomes these issues, and does not require an additional built component be added to provide insulation.

Together, the beams 20 and 30 form an enclosure 40 (or a series of enclosures 40) into which a structural foam 50 (FIGS. 3, 4 and 6 to 9) is deposited. Stated another way, beams 20 and 30 form the sides of a series of "voids" or "boxes" 40 that are to be filled with the structural foam. It is believed that having the structural foam 50 poured into the enclosure 40 such that it is in full contact with the sides of structural members 20 and 30 when the plank is initially assembled (i.e.: prior to the structure being moved from a factory setting to the building jobsite) increases the strength of the present system. Advantageously as well, structural members 20 and 30 preferably have the same heights when placed on their sides (as illustrated) such that the enclosures 40 into which the foam is filled all have sides that are the same depth. This facilitates manufacturing when the structural foam is initially poured into the voids 40 between structural members 20 and 30.

In preferred aspects, the structural foam 50 is an expanded polystyrene foam having a density from 1.5 to 3.0 PFC (pound-force per cubic foot). In preferred embodiments, the structural foam used may be Geocell foam made by Geocel Products Group of Cleveland, OH. The present structural foam has the advantages of being lightweight, having a low density, offering thermal insulation benefits, having a long-life performance, and having limited water absorption. It is to be understood, however, that the present system is not limited to the use of this particular foam or any other type of foam. As such, the present system encompasses a wide variety of various open and closed cell foams.

When the present system is being manufactured, structural foam 50 is placed into enclosure(s) 40 where it then is allowed to set and solidify. Preferably, a bottom wall (60 in FIG. 4) is placed onto the bottom of enclosure 40 prior to adding foam 50 into the enclosure(s) 40. Bottom wall 60 may simply be connected to the plurality of structural beams 20 and 30 using a variety of mounting systems, and the structural building foam 50 can then be deposited on top of bottom wall 60. Bottom wall 60 may optionally be made of aluminum, steel or other suitable metal. Thereafter, the structural building foam 50 sets and hardens in place. At the jobsite, an optional waterproofing layer (62 in FIG. 3) may be applied below bottom wall 40 (i.e., between building foundation 10 and the ground), as desired. In additional preferred aspects, pressure can also be applied onto the top of foam 50 to assist in having the foam 50 set and solidify with uniform dimensions. Having structural members 20 and 30 have the same heights as illustrated ensures that structural foam 50 will have the same depth across the plank. Moreover, a top wall (70 in FIGS. 3 and 4) can be used to cover the top of the structural plan foundation after foam 50 has been added. Having the top of the filled structural foam 50 in direct contact with the underside of top wall 70 will ensure there are no undesirable voids in the plank. The top wall 70 may optionally be made of plywood, or of another suitable material which may then be covered by plywood. As such, in preferred embodiments, the present system provides a structural building foundation in the form of a "sandwich" with a top plywood layer, a middle foam and structural member layer, and a bottom metal layer. Having all three of these layers in contact with one another, with the middle layer filled with structural foam (such that there are no undesirable voids or empty spaces therein across the entire structure) results in load sharing and distribution resulting in a high strength building foundation. Further advantages of using structural foam 50 in enclosure 40 is (as compared to traditional building foundation methods) include reduced construction time, lower construction cost, stability and ease of handling. An advantage of using plywood as the top of the structure is that it is easily drillable or can be used with nails to attach walls or other structures thereon.

As seen best in FIG. 1, the plurality of structural beams 20 and 30 that form a structural plank building foundation 10 may comprise outer edge walls (i.e.: the two beams 20A and two beams 30A forming the outer perimeter of the illustrated rectangular building plank foundation); and inner support walls (i.e.: the remaining interior beams 20 and 30) spanning between the outer edge walls. As can also be seen, all of beams 20 and 30 may preferably have the same vertical height such that all of the separate enclosures/boxes 40 have the same vertical height. This makes it very easy to fill foam 50 to the same level across the entire structural plank building foundation 10. Preferably, all of the structural beams 20 and 30 are rectangular in cross-section as shown; however, other possibilities and dimensions are also contemplated within the scope of the present invention. Moreover, as can also be seen, beams 20 and 30 all preferably have the same heights across the plank such that the side edges of the beams are in contact with the top and bottom of the plank (i.e.: the side edges of beams 20 and 30 touch bottom wall 60 and top wall 70 in FIG. 3 or touch top laminated panel 202 and bottom laminated panel 204 in FIG. 10A). Having the side edges of each of beams 20 and 30 be in direct contact either with bottom wall 60 and top wall 70 or with panels 202 and 204 provides load distribution that strengthens the present structural plank system.

Figure 3:
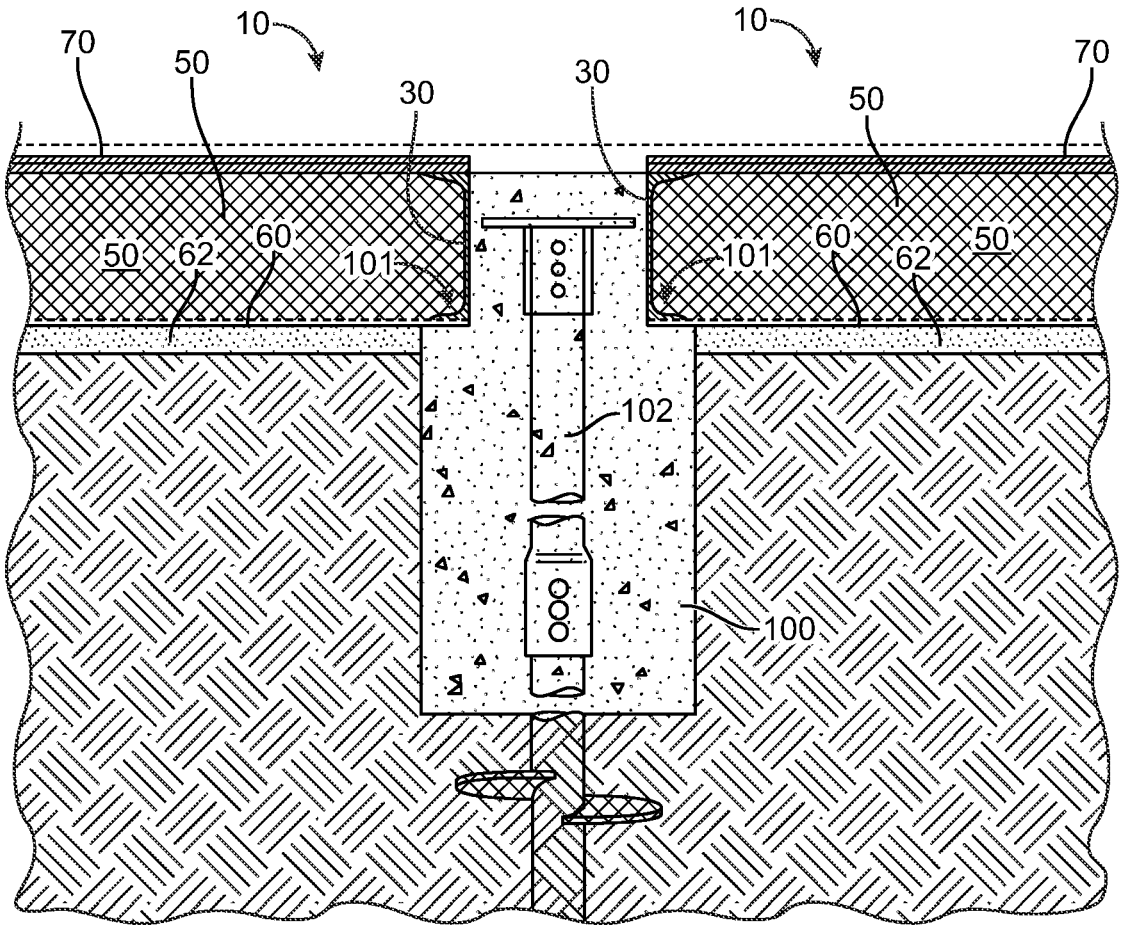
FIG. 3 is a sectional side elevation view of part of the present structural plank building foundation mounted onto a pier, with the building foundation sitting on the ground.
Figure 4:
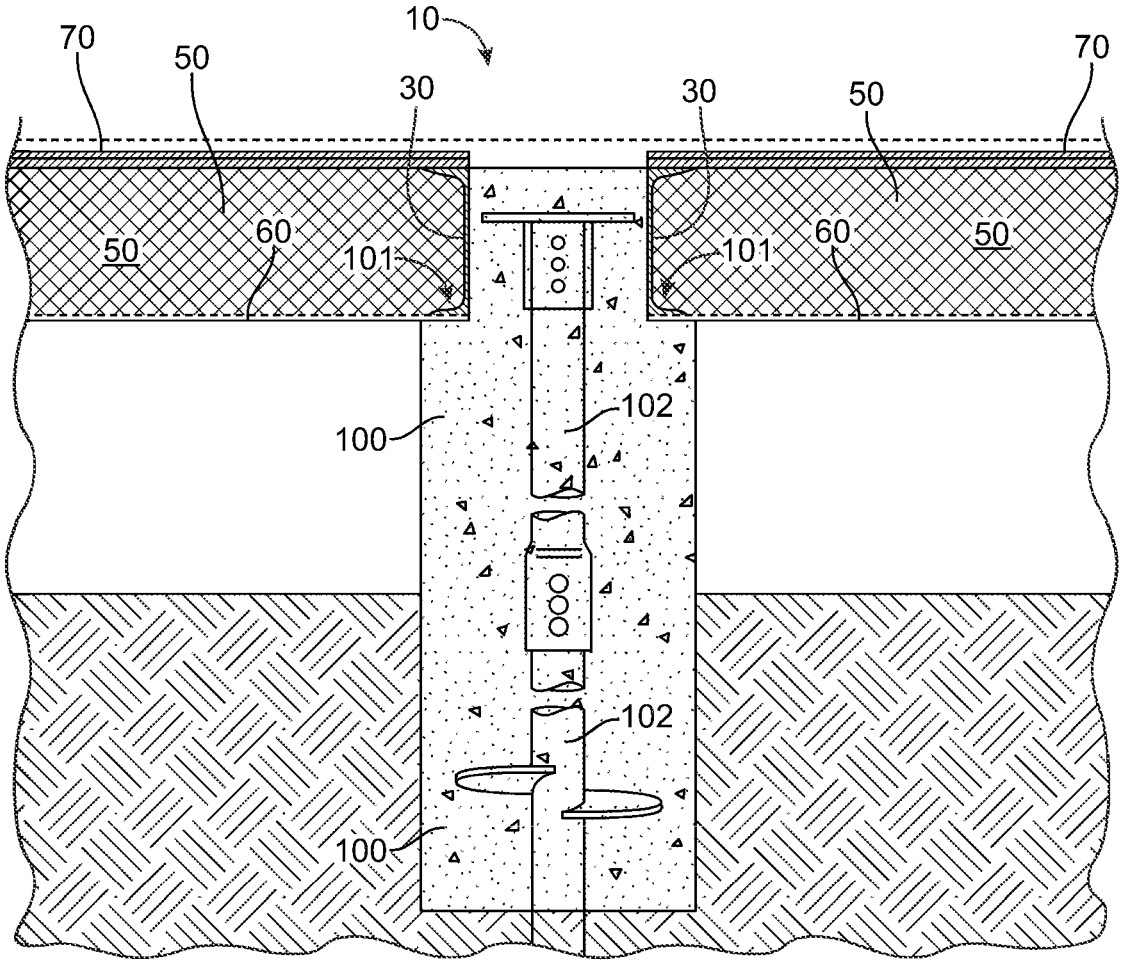
FIG. 4 is a sectional side elevation view of part of the present structural plank building foundation mounted onto a pier, with the building foundation raised above the ground.

As seen in FIGS. 2, 3 and 4, an array of building piers 100 may also be included. In these exemplary embodiments, the inner support walls 30 are positioned against building piers 100 such that the array of building piers 100 supports the building foundation 10 thereon. In this example, the location of piers 100 enables building foundation 10 to support cantilevered loads.

FIG. 3 illustrates the embodiment of the present system where the building foundation 10 rests on the ground. An optional waterproofing layer 62 can be provided below bottom wall 60. Conversely, FIG. 4 illustrates the embodiment of the invention where the building foundation 10 is elevated above the ground by the array of piers 100. As can be seen, piers 100 are preferably dimensioned with a top edge 101 that supports a bottom edge of building foundation 10. As can also be seen, piers 100 preferably comprise a central helical screw-type structure 102 that is inserted deeply into a hole in the ground, and then screwed into the ground below. Later, the hole is filled with concrete resulting in a concrete-topped structure that projects above ground as seen in FIG. 3. Alternately, as shown in FIG. 4, a larger portion of the concrete-topped pier 100 may project above the ground, such that pier 100 supports building foundation 10 above the ground as shown.

Figure 5:
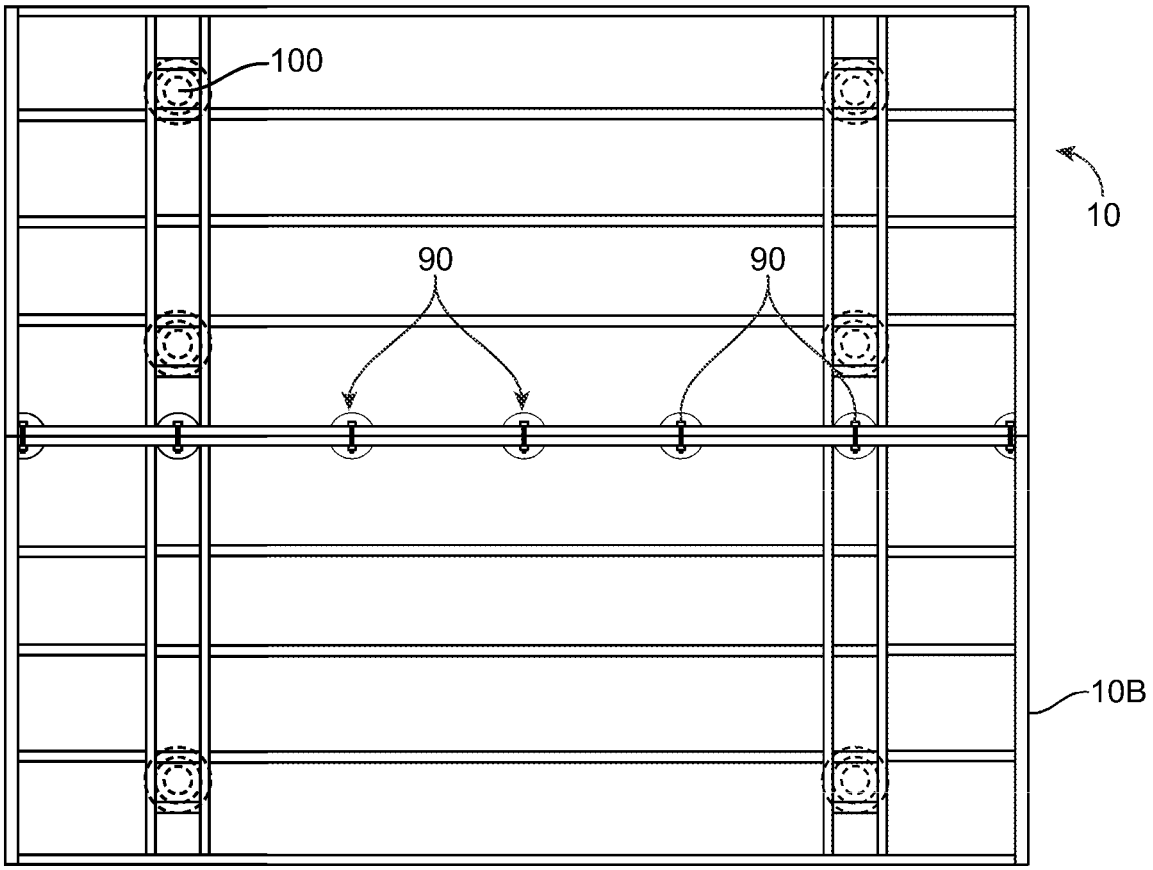
FIG. 5 is a top plan view of a pair of the present structural plank building foundations connected together.

FIG. 5 illustrates the embodiment of the invention in which a first building foundation 10 is connected to a second building foundation 10B by mechanical connectors 90. FIG. 5 illustrates the important advantage of the present system in that the present building foundation may be assembled from a plurality of smaller building foundations 10. As such, smaller sections of the building foundation can be made in a factory and then shipped to a job site where they can be assembled together such that easy to manufacture and transport building foundations can be used to support much larger building foundations.

Figure 6:
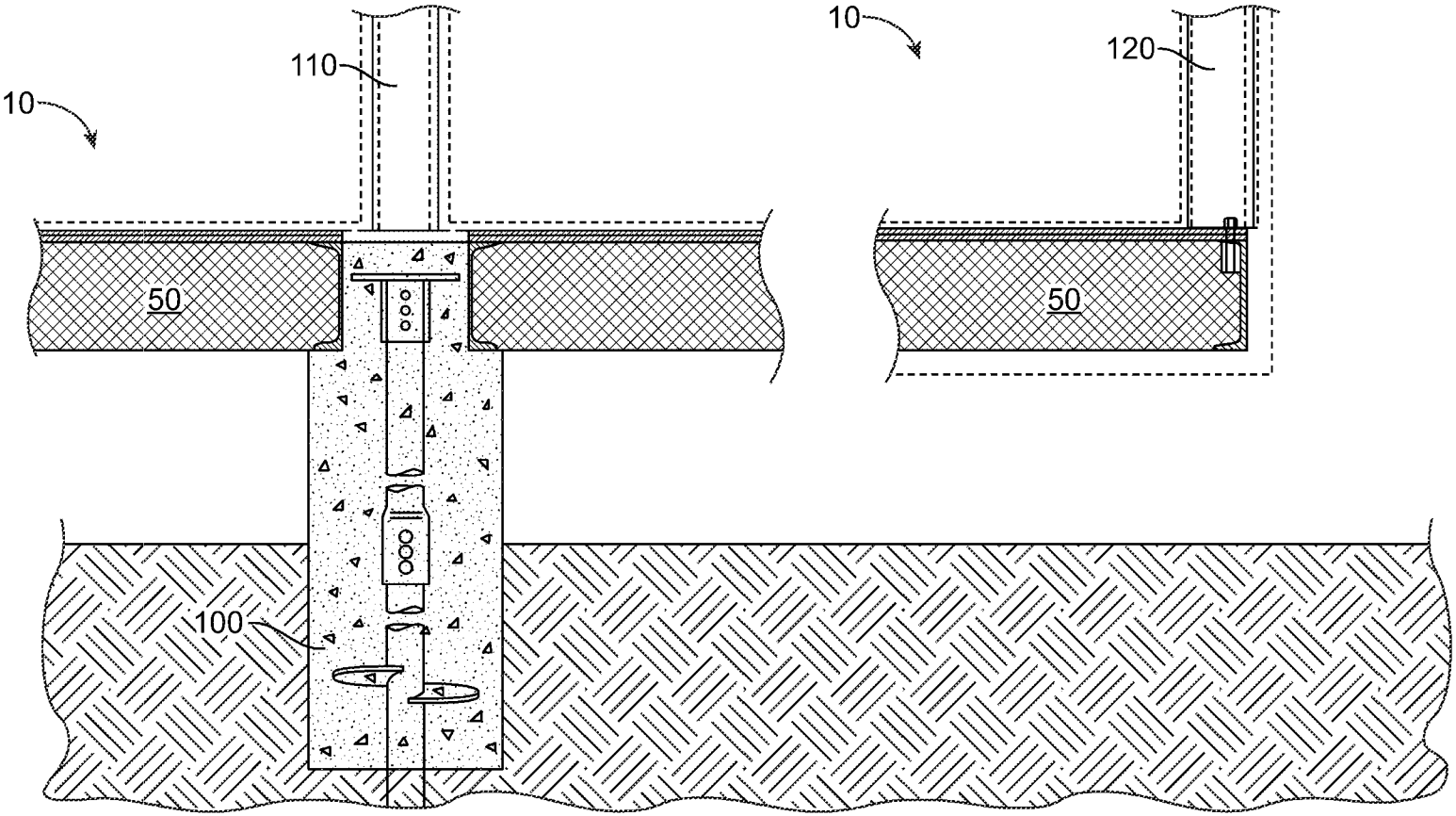
FIG. 6 is a sectional elevation view showing both interior and exterior walls mounted to the present structural plank building foundation.

FIG. 6 illustrates both interior and exterior walls connected to building foundation 10. Specifically, an optional inner shear wall 110 and an optional exterior foam wall 120 can be connected to building foundation 10, as shown. As such, inner shear wall 110 may be directly supported above pier 100 whereas exterior wall 120 will be cantilevered from pier 100. Walls 110 and 120 may be connected to building foundation 10 by mechanical couplers passing through metal flanges.

Figure 7:
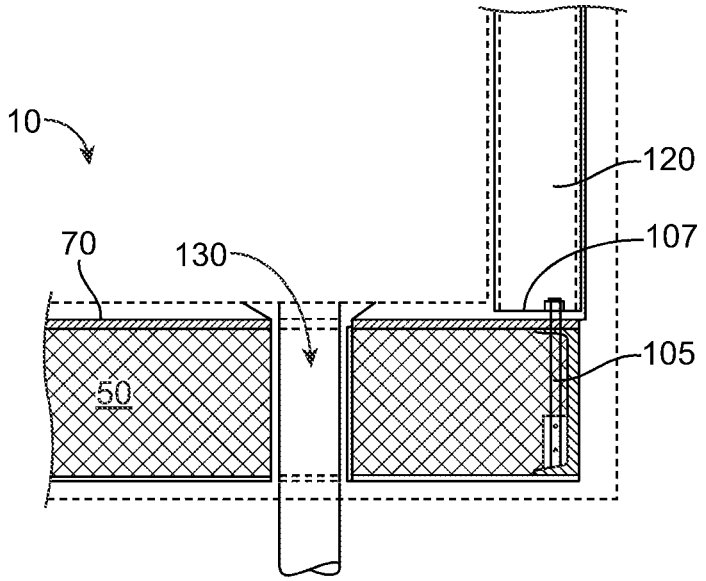
FIG. 7 is a close-up sectional elevation view of the area where an exterior wall is mounted to the present structural plank building foundation showing an optional floor penetration.

FIG. 7 illustrates an optional floor penetration 130 passing vertically through building foundation 10. Also illustrated is a mechanical coupler 105 in building foundation 10 being connected through top wall 70 of building foundation 10 and through a metal flange 107 at the bottom of exterior wall 120, thereby connecting exterior wall 120 to building foundation 10.

Figure 8:
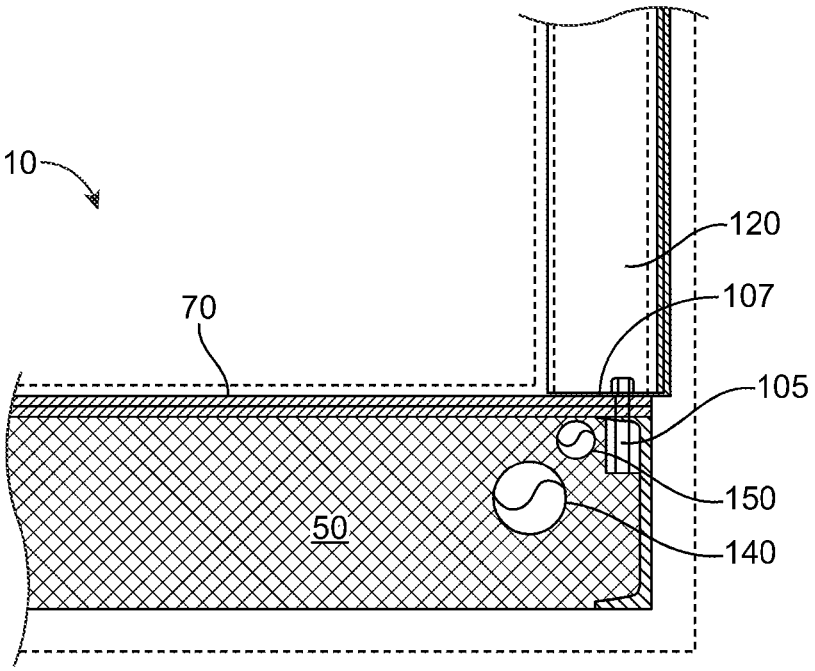
FIG. 8 is a view similar to FIG. 7, but showing passageways both for electrical conduits and for HVAC air vents in the structural building foam.

FIG. 8 illustrates an optional plurality of openings 140 and 150 passing through the building foundation. Openings 140 and 150 may be cut into the structural building foam 50 after the structural building foam has set within the enclosure(s) 40. As illustrated, smaller openings 150 are dimensioned to permit electrical wiring to pass therethrough, and larger openings 140 are dimensioned as HVAC conduits for air to pass through. It is to be understood that the paths and layout of openings 140 and 150 can be in many different forms, locations and dimensions, all keeping within the scope of the present invention.

As seen in both FIGS. 7 and 8, the connecting mechanisms 105 used to attach outer wall 120 to structural building foundation 10 may be disposed within the building foundation, and later covered by foam 50.

Figure 9:
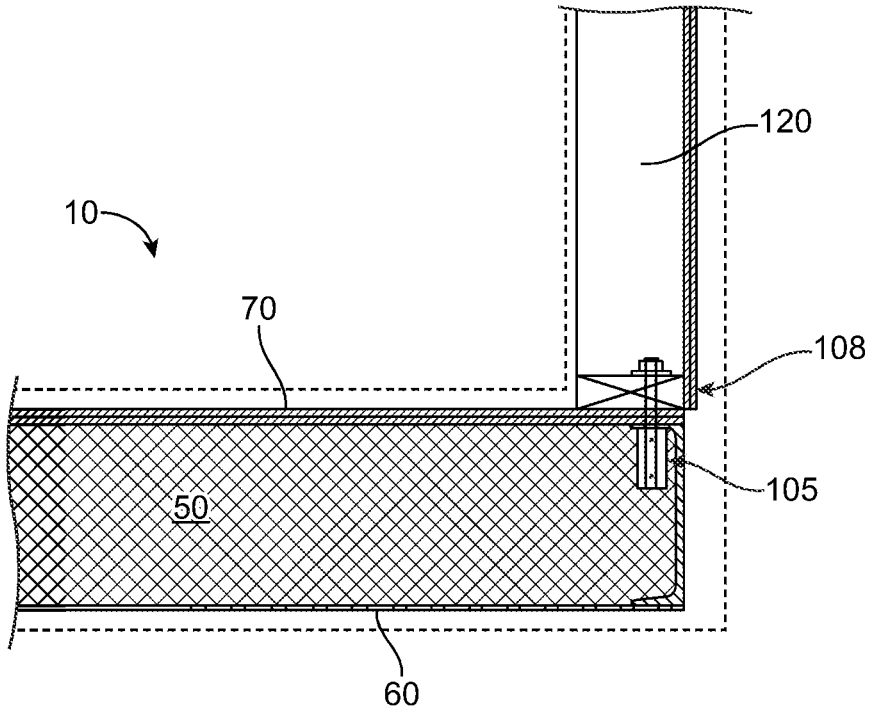
FIG. 9 is another close-up sectional elevation view of the area where an exterior wall is mounted to the present structural plank building foundation.

FIG. 9 illustrates another example of an outer wall 120 secured to building foundation 10 in which a structural plate or mudsill 108 is used instead of the metal flange 107 of FIGS. 7 and 8.

Figure 10A:
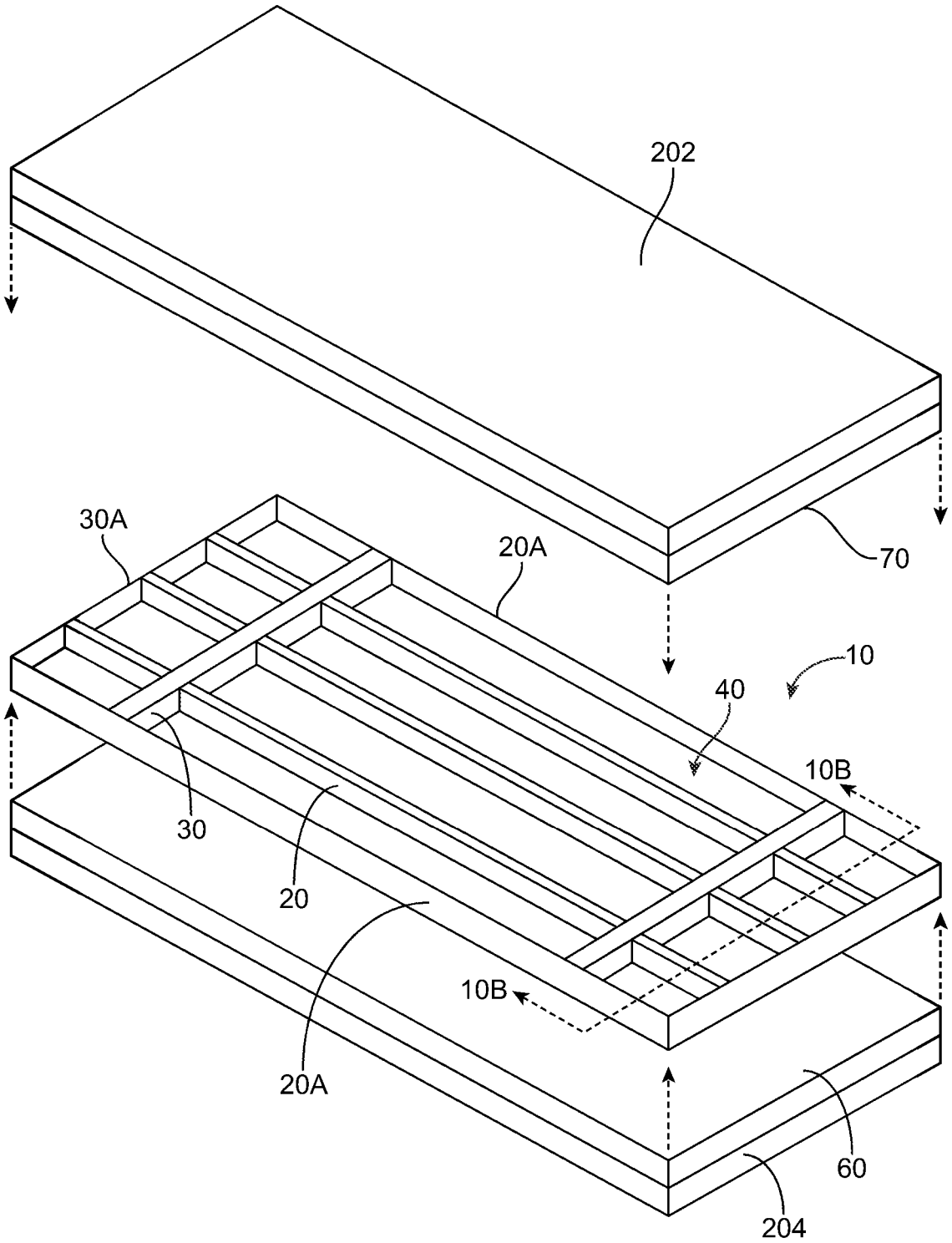
FIG. 10A is an exploded perspective view of the structural plank similar to FIG. 1 receiving laminated top and bottom panels adhered thereto.
Figure 10B:
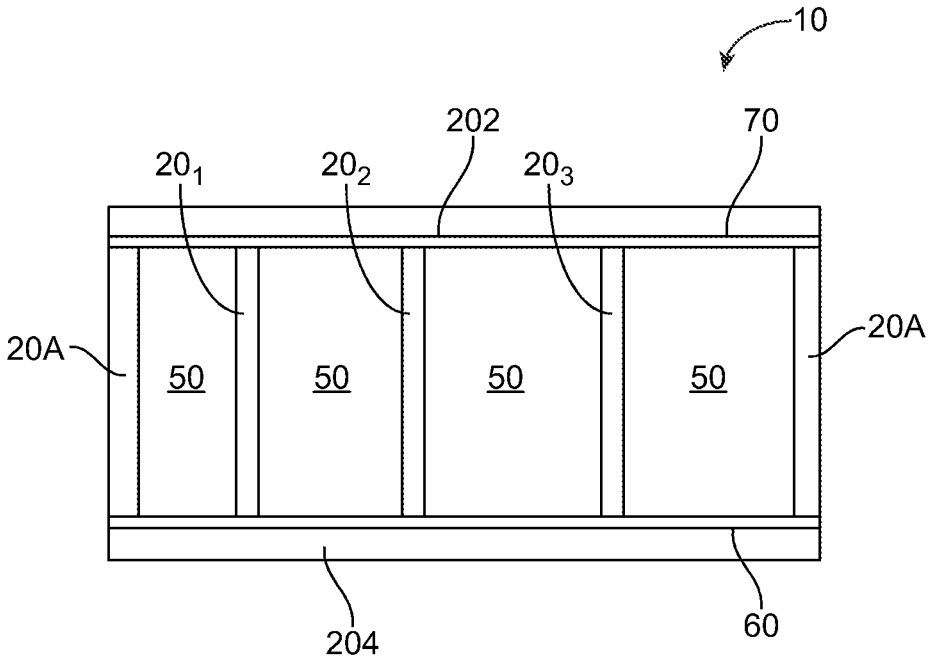
FIG. 10B is a side elevation view corresponding to FIG. 10A.

FIG. 10A is an exploded perspective view of a structural plank similar to FIG. 1 receiving laminated top and bottom panels 202 and 204 respectively adhered thereto. In preferred embodiments, the structural plank of FIG. 10A has bottom and top walls 60 and 70 thereon, and panels 202 and 24 are received thereover, (i.e.: top panel 202 sits on top of top wall 70 and bottom panel 204 sits underneath of bottom wall 60). In other optional embodiments, laminated panels 202 and 204 simply replace top and bottom walls 70 and 60, respectively. FIG. 10B is a side elevation view taken along line 10B–10B in FIG. 10A. Laminated panels 202 and 204 may be adhered to structural plank 10 by thermal set epoxy or glue. In preferred embodiments, laminate panels 202 and 204 may be made of a fabric mesh. In other preferred aspects, laminate panels 202 and 204 may be made of a fossil fuel mesh including, but not limited to, rayon, polypropylene or nylon, most preferably having a weight from 1.5 to 16 oz / square yard. In other preferred aspects, laminate panels 202 and 204 may be made of a carbon-based mesh including, but not limited to, graphene or Kevlar, most preferably having a density from 170 g/m$^3$ to 300 g/m$^3$ (or optionally 210-250 g/m$^3$, or 180-290 g/m$^3$). In other preferred aspects, laminate panels 202 and 204 may be made of a plant-based mesh, including, but not limited to, hemp or Burlap. In other preferred aspects, laminate panels 202 and 204 may be made of a synthetic acrylic or cementious composite, including but not limited to Elephant Armor®, Thorocoat®, EIFS systems Kryton®, or HMI mortar. In other preferred aspects, laminate panels 202 and 204 may be made of a product made by a pultrusion process that can optionally be fiberglass, graphene, carbon, glass fiber reinforced carbon, or fiberglass based. In other preferred aspects, laminate panels 202 and 204 may be made of wood based panel products including, but not limited to, cellulosic panels; Plywood, MDF (Medium Density Fiberboard), MDO (Medium Density Overlay), OSB (Oriented Strand Board), Finply®, Plyboo®, Hempboard, Flaxboard, Particleboard, and Strawboard. The advantage of laminated panels 202 and 204 are that they significantly increase the tensile strength of the structural plank. It is to be understood that laminate panels 202 and 204 may be made of any of the above listed materials either alone or in combination with one another, or in combination with other suitable materials.

In various alternate embodiments seen in FIG. 10B, structural members $\mathbf{20}_1$, $\mathbf{20}_2$, and $\mathbf{20}_3$ may either be steel or aluminum members (similar to members 20 and 20A in FIG. 1), or may be sections of laminated panels (similar in structure to top and bottom panels 202 and 204). In addition, side structural members 20A may also either be steel or aluminum members (similar to members 20 in FIG. 1), or may be sections of laminated panels (similar in structure to top and bottom panels 202 and 204). It is to be understood that the present system and techniques comprise all embodiments where structural members 20 and 30 may be steel or aluminum (or other metal) members or sections of laminated panels. As can be seen, structural members 20A, $\mathbf{20}_1$, $\mathbf{20}_2$ and $\mathbf{20}_3$ all preferably reach from the top to the bottom of the structural plank 10, with the entire remainder of the present structure filled with structural foam 50. The Applicants have tested the present structure under loading and achieved excellent results.

Importantly as well, the present system encompasses embodiments where structural plank 10 is used in the horizontal orientation shown to be a building foundation or a ceiling or flat roof section. Additionally, however, structural plank 10 can instead be positioned vertically to function as an (interior or exterior) building wall. Structural plank 10 can also optionally be positioned in other orientations (for example, as a section of a sloping building roof). When used as a wall, the present structure can both be used as an above-grade wall and as a below-grade wall. When used below grade, a layer of waterproofing material can be added to the exterior side of the wall. An advantage of using the present structure as a wall is that the structural foam therein will act as insulation, thereby removing (or at least reducing) the need for additional insulation adjacent to the building wall.

Figure 11:
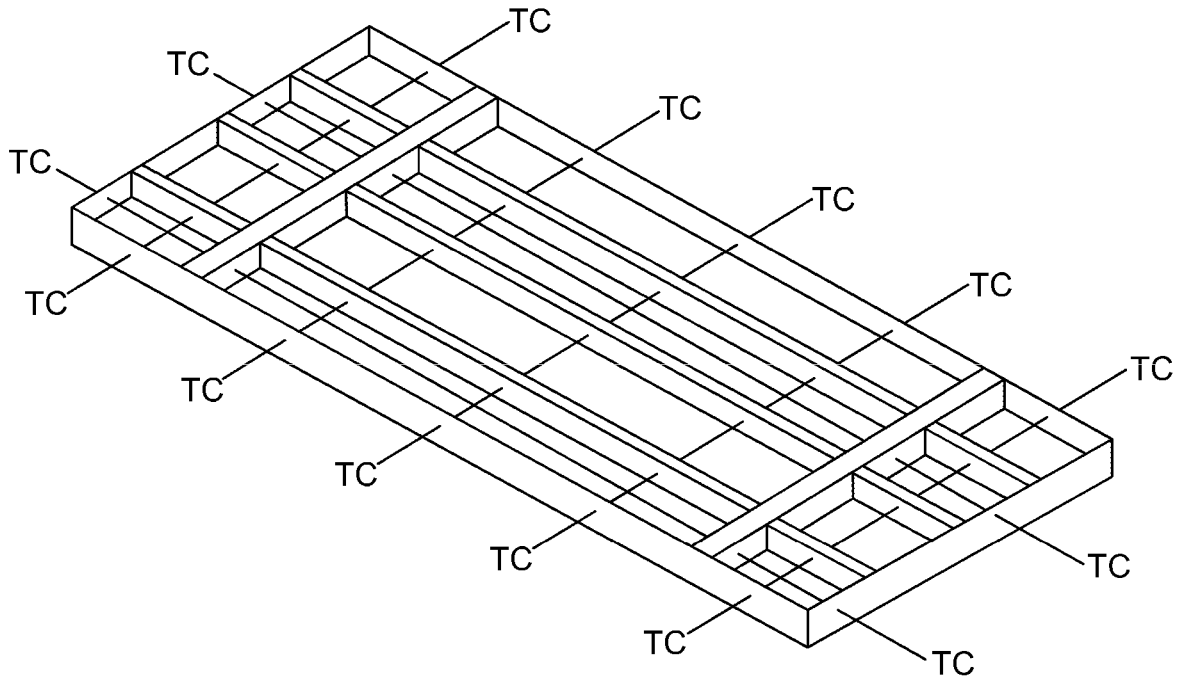
FIG. 11 is a perspective view of a system similar to FIG. 1, further adding a plurality of post tension cables passing therethrough.

FIG. 11 is a perspective view of a system similar to FIGS. 1 and 10, further adding a plurality of post tension cables TC passing therethrough. These post tension cables TC are used after foam 40 has set to provide further strength (for example when structural plank 10 is used as a building foundation).

Figure 12:
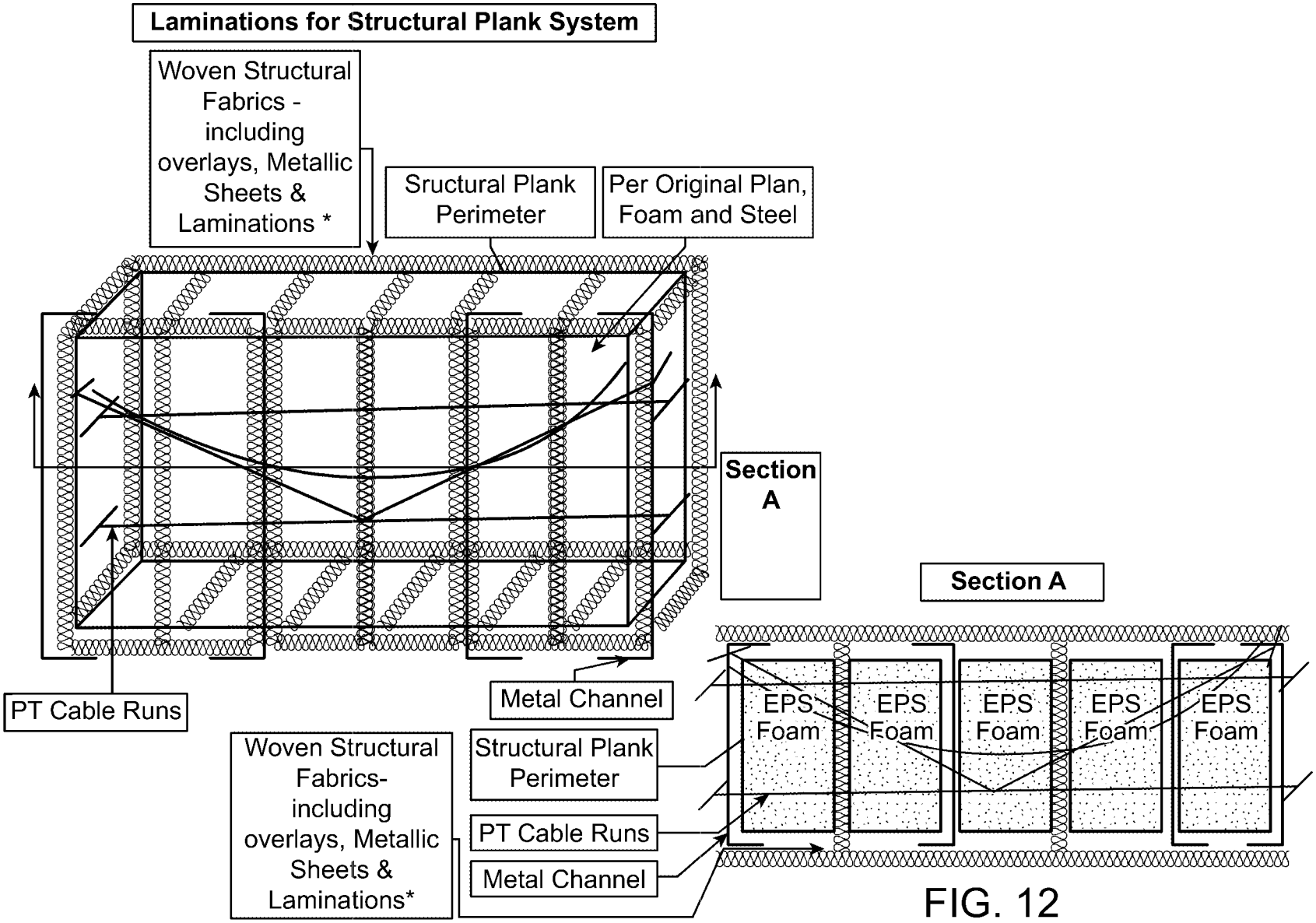
FIG. 12 is an illustration of a schematic rendering of various laminations of the present system (showing both a longitudinal and a sectional view therethrough).

FIG. 12 illustrates a schematic rendering of various laminations of the present system (showing both a longitudinal and a sectional view therethrough). The illustrated cable alignments correspond to the section A blow up. Specifically, the cables that are shown as straight runs reflect compression systems, whereas the V-shaped and C-shaped cable illustrations are over accentuated to represent load bearding on deflections. It is to be understood that the present system encompasses different cable geometries, placements and cable types without limitation. It is also to be understood that the final cable design and configuration will be specific to the dynamic loads that the structural plank has to react to. As such, the final design may be a composite of different cable systems and placements within the same building structural plank.

Experimental Results

The Applicant has successfully built and tested embodiments of the present structural plank building foundation. The tests performed included a "Heavy Gauge Floor Plank In Compression", a "Heavy Gauge Floor Plank In Flexure" and a "Light Gauge Floor Plank In Flexure" test, as follows.

Figure 13A:
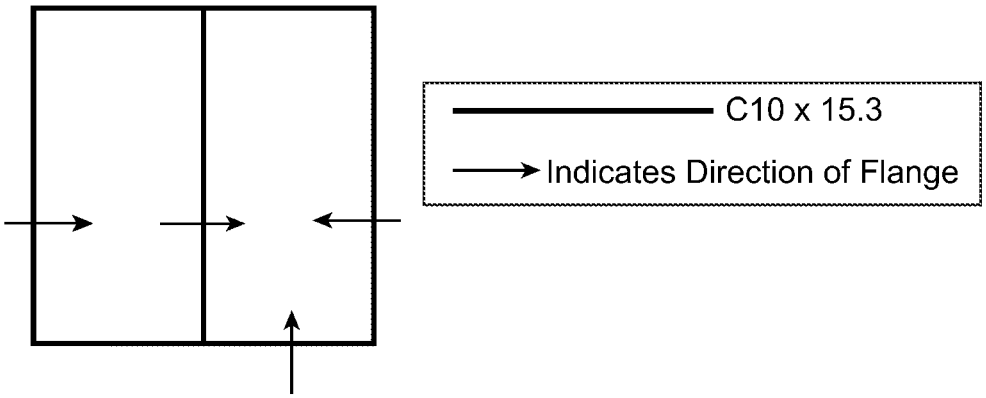
FIG. 13A is a top plan view of a 4′ by 4′ Heavy Gauge Floor Plank Framing.

For the Heavy Gauge Floor Plank In Compression test, a 4 by 4 structure as illustrated in FIG. 13A was formed having C10 × 15.3 steel channel perimeters with a 0.125" mild steel metal skin on the bottom and a ¾" plywood decking forming a top surface. A rigid 1.5 lb foam core was used. The plank held 13007.28 pounds per square foot of load or about 90.33 psi. This was an excellent result.

Figure 13B:
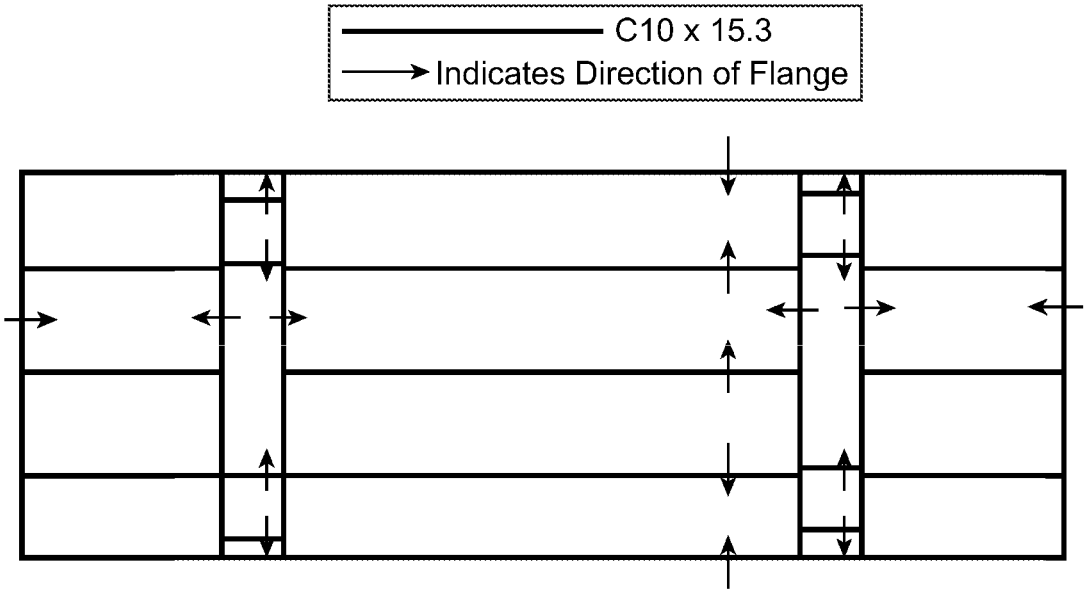
FIG. 13B is a top plan view of an 8′ by 20′ Heavy Gauge Floor Plank Framing.
Figure 13C:
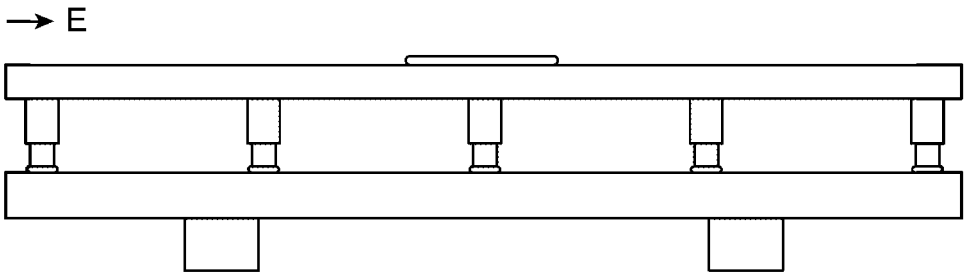
FIG. 13C is a side elevation view of the Heavy Gauge Floor Plank Flexure Test.

For the Heavy Gauge Floor Plank In Flexure test, an 8′ × 20′ structure as illustrated in FIG. 13B was formed using C10 × 15.3 steel channel members positioned as shown with a 0.125" mild steel metal skin on the bottom and a ¾" plywood decking forming a top surface. A rigid 1.5 lb foam core was used. Loading was performed as illustrated in the side view of FIG. 13C. This test was performed to evaluate how the plank would perform when sitting on top of a helical pier foundation. A loading before failure of 2461.23 lb/ft was achieved. Again, this was an excellent result.

Figure 13D:
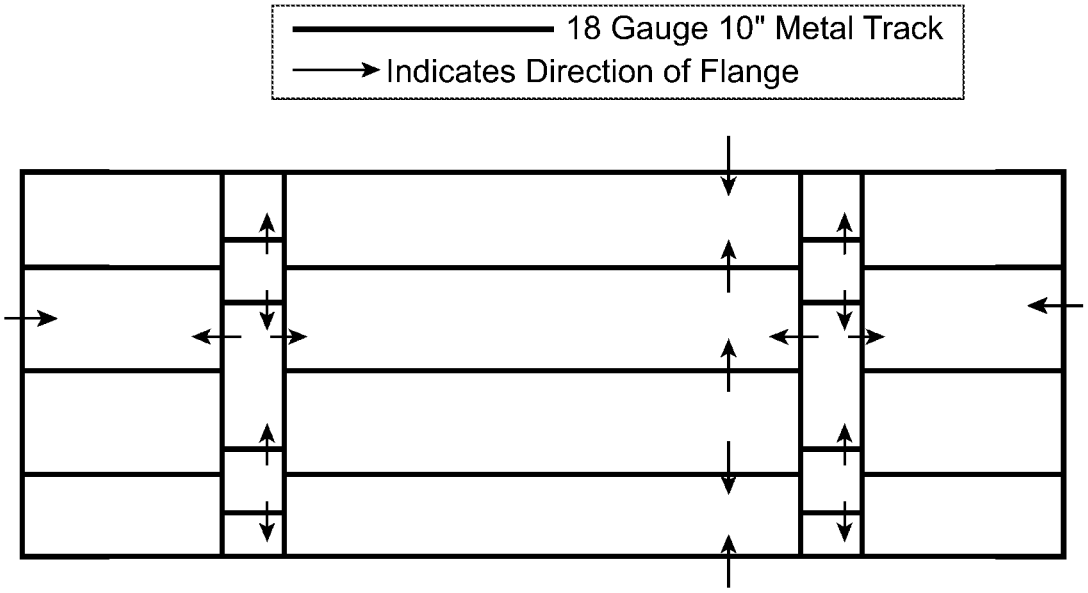
FIG. 13D is a top plan view of an 8′ by 20′ Light Gauge Floor Plank Framing.

For the Light Gauge Floor Plank In Flexure test, an 8′ × 20′ structure as illustrated in FIG. 13D was formed using 128 gauge metal track steel channel members positioned as shown with a 0.125" mild steel metal skin on the bottom and a ¾" plywood decking forming a top surface. A rigid 2.0 lb foam core was used. The test achieved a 4,332.80 lb/ft2 of equivalent distributed loading at failure. Again, this was an excellent result.

A table summarizing the test results is shown below.

| Test | Max Force | Max Load (Alt) | Design Load (Alt) |
|---|---|---|---|
| Heavy Gauge Floor Plank in Compression | 208.1165 kips | 13007.28 lb/ft² | 2275 lb/ft² |
| Heavy Gauge Floor Plank in Flexure | 393.797 kips | 2461.23 lb/ft² (4,332.80 lb/ft²) | 430 lb/ft² (758 lb/ft²) |
| Light Gauge Floor Plank in Flexure | 65.6643 kips | 410.40 lb/ft² (722.48 lb/ft²) | 72 lb/ft² (126 lb/ft²) |

Based on these results, all of the variations of the plank are suitable for building usage as it is strong enough to handle the average 10-20 lb/ft2 dead load and 30-40 lb/ft2 live load as indicated in Chapter 5 of the 2021 International Residential Code.

The Heavy Gauge Floor Plank is suitable for use as both a building foundation and a floor element. With a design load of 3250 lbs/ft² in compression, this exceeds the load-bearing pressure for sandy gravel, gravel and other classes of material with a load-bearing pressure of 3,000 lbs/ft² or less as stated in Table R401.4.1 of the 2021 International Residential Code. In addition, the Heavy Gauge in Floor Plank can be used as a floor framing element as the design load of 430 lbs/ft² is more than sufficient to cover the 10-20 lb/ft² of dead load and 30-40 lb/ft² of live load required for floor framing elements and other potential loads.

The Light Gauge Floor Plank is suitable for use as a floor element. Its design load of 72 lb/ft² makes it suitable to cover the required 10-20 lb/ft² of dead load and 30-40 lb/ft² of live load as required within Chapter 5 of the 2021 International Residential Code. More testing needs to be done to determine its suitability as a foundation.

What is claimed is:

1. A foam filled structural plank load bearing building foundation, comprising:

a plurality of structural beams connected together to define a structural plank building foundation, the structural plank building foundation being capable of supporting the weight of a building resting directly thereon, wherein the plurality of structural beams define an enclosure therebetween and an outer perimeter therearound;

a bottom wall on the enclosure, wherein the bottom wall is connected to the plurality of structural beams;

a top wall on the enclosure, wherein the top wall is connected to the plurality of structural beams;

a structural building foam filling the enclosure, wherein the structural building foam is poured on top of the bottom wall prior to the structural building foam setting in place and wherein the structural building foam is in direct contact with the plurality of structural beams and with the bottom wall and with the top wall; and at least one of:

a bottom laminate panel covering and being in direct contact with the bottom wall; or a top laminate panel covering and being in direct contact with the top wall.

2. The structural plank of claim 1, wherein the building foundation further comprises:

a plurality of laminate panels extending at least partially through an inner portion of the structural plank building foundation.

3. The structural plank of claim 1, wherein at least one of the top or bottom laminate panels comprise at least one of the following:

(a) a fabric mesh, (b) a fossil fuel mesh including, Rayon, Polypropylene or Nylon, having a weight from 1.5 to 16 oz. / square yard, (c) a carbon based mesh including, graphene or Kevlar, having a density from 170 g/m$^3$ to 300 g/m$^3$ (or 210-250 g/m$^3$, or 180-290 g/m$^3$), (d) a plant based mesh, including but not limited to hemp or burlap, (e) a synthetic acrylic or cementious composites, (f) a product made by a pultrusion process including fiberglass, graphene, carbon, glass fiber reinforced carbon, or fiberglass based, or (g) wood based panel products including, cellulosic panels; plywood, Medium Density Fiberboard, Medium Density Overlay, Oriented Strand Board, plywood panels, bamboo board, hempboard, flaxboard, particleboard, or strawboard.

4. The structural plank of claim 2, wherein a plurality of the laminate panels are positioned parallel to one another.

5. The structural plank of claim 1, wherein the structural building foam is an expanded polystyrene foam having a density from 1.5 to 3.0 PFC (pound-force per cubic foot).

6. The structural plank of claim 1, wherein the bottom wall is made of metal and the top wall is made of wood.

7. The structural plank of claim 1, wherein some of the plurality of structural members form the perimeter of the structural plank and others of the plurality of structural members pass across interior mid-sections of the structural plank.

8. The structural plank of claim 7, wherein all of the plurality of structural members have the same heights such that all of the plurality of structural members are in direct contact with the top and bottom walls to provide load sharing and distribution through the structural plank.

9. The structural plank of claim 1, wherein the structural building foam has a plurality of openings cut therein to permit electrical wiring or HVAC air conduits to pass therethrough.

10. The structural plank of claim 1, wherein the plurality of structural beams are made of steel or aluminum.

11. A foam filled structural plank load bearing building foundation, comprising:

a plurality of structural beams connected together to define a structural plank building foundation, the structural plank building foundation being capable of supporting the weight of a building resting directly thereon, wherein the plurality of structural beams define an enclosure therebetween and an outer perimeter therearound;

a bottom wall on the enclosure, wherein the bottom wall is connected to the plurality of structural beams;

a top wall on the enclosure, wherein the top wall is connected to the plurality of structural beams;

a structural building foam filling the enclosure, wherein the structural building foam is poured on top of the bottom wall prior to the structural building foam setting in place and wherein the structural building foam is in direct contact with the plurality of structural beams and with the bottom wall and with the top wall; and an array of piers, wherein interior structural members of the structural plank are positioned on top of the piers with a top edge of each pier supporting a bottom edge of the bottom wall of the structural plank, and wherein placement of the interior structural members of the structural plank define openings through the structural plank through which the piers are received.

12. The structural plank of claim 1, wherein the structural plank is a horizontally oriented building foundation capable of supporting the weight of a building thereon.

13. A method of forming a foam filled structural plank load bearing building foundation, comprising:

assembling a plurality of structural beams together to form a structural plank, wherein the plurality of structural beams define an enclosure therebetween and an outer perimeter therearound;

assembling a bottom wall onto the enclosure, wherein the bottom wall is connected to the plurality of structural beams; and then filling the enclosure with a structural building foam by pouring the structural building foam onto the bottom wall;

assembling a top wall onto the enclosure, wherein the structural building foam is in direct contact with the top wall;

attaching at least one of:

a bottom laminate panel onto the bottom wall, or a top laminate panel onto the top wall; while permitting the structural building foam to set prior to transporting the structural plank to a building jobsite.

14. The method of claim 13, further comprising:

assembling a plurality of laminate panels extending across an inner portion of the structural plank prior to filling the enclosure with the structural building foam.

15. The method of claim 13, further comprising:

cutting openings into the structural building foam after the structural building foam has set within the enclosure, wherein the openings are dimensioned to permit electrical wiring or HVAC air to pass therethrough.

16. The structural plank of claim 11, wherein each pier comprises:

a helical screw inserted into a hole in the ground wherein a bottom end of the helical screw extends down below the bottom of the hole in the ground, and a concrete mixture filling the hole around the helical screw, thereby resulting in a concrete topped structure that projects above ground level.

17. The structural plank of claim 11, further comprising:

a waterproofing membrane, wherein:

the structural plank is positioned directly on top of the waterproofing membrane, and the waterproofing membrane is positioned directly on top of the ground.

18. The structural plank of claim 16, wherein the structural plank is supported above the ground by the concrete topped structure on each of the piers.

19. The structural plank of claim 11, further comprising:

an inner shear wall connected to the structural plank, wherein the inner shear wall is supported by at least one of the piers being positioned directly thereunder.

20. The structural plank of claim 11, further comprising:

an exterior foam wall connected to the structural plank, wherein the exterior foam wall is supported cantilevered from at least one of the piers, and wherein coupling mechanisms used to attach the exterior foam wall that is connected to the structural plank are disposed within the structural plank and are covered by the structural building foam.

21. The structural plank of claim 1, further comprising:

a plurality of mechanical connectors on a side of the structural plank, the mechanical connectors permitting a plurality of structural planks to be assembled together side-by-side.

* * * * *